United States Patent [19]

Sharber

[11] 4,444,319

[45] Apr. 24, 1984

[54] NOTE PAPER RETRIVAL TRAY

[75] Inventor: Jerry L. Sharber, Toledo, Ohio

[73] Assignee: Sheller-Globe Corporation, Toledo, Ohio

[21] Appl. No.: 271,704

[22] Filed: Jun. 8, 1981

[51] Int. Cl.[3] ..... A47F 7/00

[52] U.S. Cl. ..... 211/50; 206/449

[58] Field of Search ..... 211/50, 51, 490; 206/557, 564, 449, 39, 39 S; D6/140, 199

[56] References Cited

U.S. PATENT DOCUMENTS

| | | | |
|---|---|---|---|
| 1,004,334 | 9/1911 | Anderson | 211/50 |
| 1,532,436 | 4/1925 | Musil | 211/50 X |
| 1,560,009 | 11/1925 | Wobber | 211/50 X |
| 1,727,011 | 9/1929 | Heilman | 206/557 X |
| 1,848,694 | 3/1932 | Bueklin | 211/50 |
| 2,462,789 | 2/1949 | Crollen | 211/50 X |
| 2,726,786 | 12/1955 | Bergendal | 206/557 X |
| 3,092,379 | 6/1963 | Collier | 211/50 X |

FOREIGN PATENT DOCUMENTS

| | | | |
|---|---|---|---|
| 579375 | 9/1976 | Switzerland | 211/50 |
| 649419 | 1/1951 | United Kingdom . | |
| 1095229 | 12/1967 | United Kingdom . | |
| 1132025 | 10/1968 | United Kingdom . | |

*Primary Examiner*—Ramon S. Britts
*Assistant Examiner*—Robert W. Gibson, Jr.
*Attorney, Agent, or Firm*—Fraser, Barker, Purdue & Clemens

[57] ABSTRACT

A tray for a stack of note paper has an inclined bottom wall on which the stack rests. The tray has supports so that it can be placed on a flat surface. At the lower end of the bottom wall is an outwardly inclined end wall against which the lower end of the stack bears. The upper end wall of the bottom is spaced from the adjacent edge of the stack. Approximately midway of the bottom wall is a depression of substantial depth and formed by two downwardly inclined wall portions which meet at their lower edges. In order to free the upper sheet from the stack the stack is pressed downwardly by a thumb or finger into the depression, thereby bending the stack and causing the edge of the uppermost sheet to flex free and be grasped conveniently and peeled from the remainder.

2 Claims, 3 Drawing Figures

NOTE PAPER RETRIEVAL TRAY

BACKGROUND AND SUMMARY OF THE INVENTION

Considerable difficulty exists in the separation and removal of individual note paper sheets from a stack even though they are free and unattached to each other. This is due to the tightly packed or pressed condition of the stack and the cohesion which exists between adjacent sheets. The removal of a single sheet at the first try is usually unsuccessful and the effort results in the separation of a multiplicity of sheets. This is not only troublesome and time consuming but often results in soiling sheets from handling.

This invention obviates the above difficulty and provides a single and effective device for the separation and removal of individual note paper sheets from a stack of them. This is achieved without the use of moving parts and in such an easy way that it can be done by anyone. A tray is employed which is downwardly slanted and on which rests a stack of note paper sheets. The bottom edge of the stack abuts an outwardly flared wall and at the upper edge is a wall which is slightly spaced from the adjacent edge of the stack. The bottom of the tray on which the paper stack lays is coplanar except for an intermediate depression of appreciable depth so that pressure on top of the stack by a finger or thumb will crowd the central portion of the stack into the depression, bending it in such manner as to flex the opposite ends of the stack upwardly. In so doing the edges of the sheets automatically separate slightly from each other. While the stack is so depressed or bent, the top sheet can be readily peeled from the stack by a finger or thumb. Of course, release of pressure on the stack causes it to flatten out and assume its normal condition.

DESCRIPTION OF PREFERRED EMBODIMENT

Figure 1:
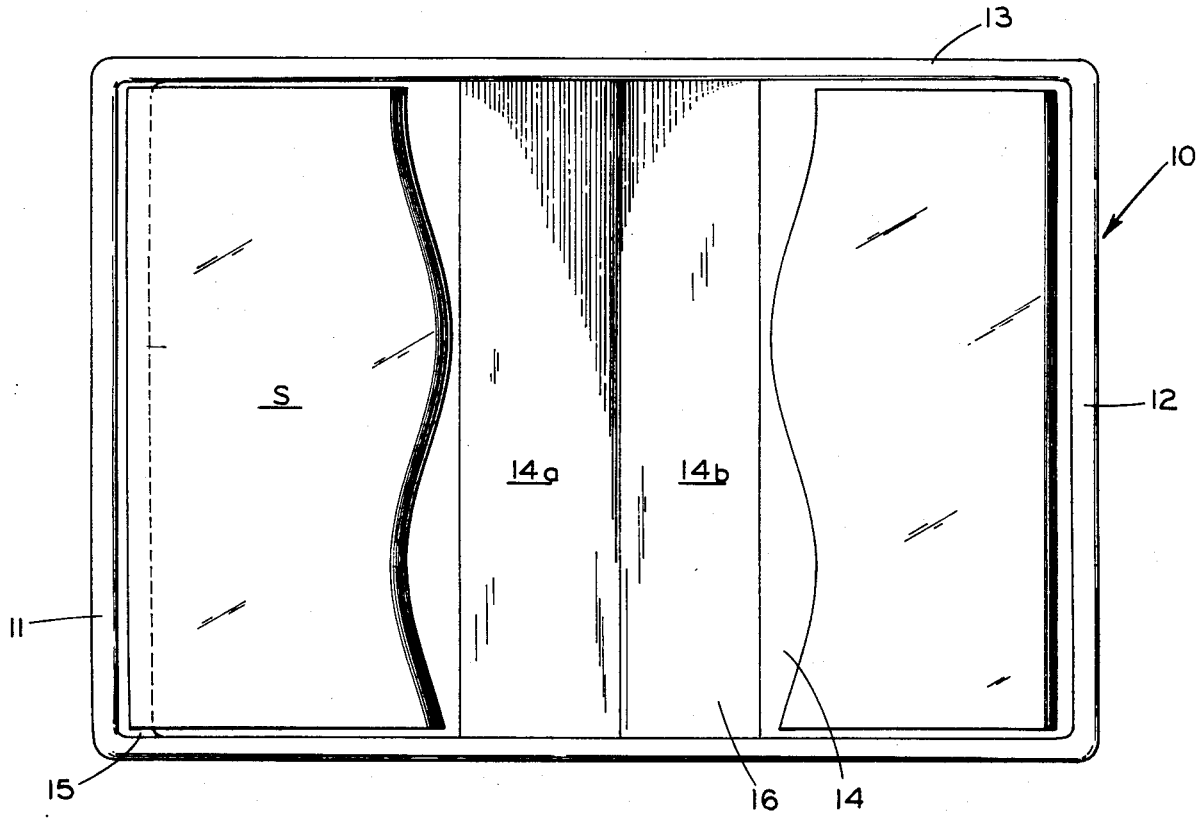
FIG. 1 is a top plan view of a tray containing a stack of note paper broken away for clarity and having a device for the easy separation of individual sheets.
Figure 2:
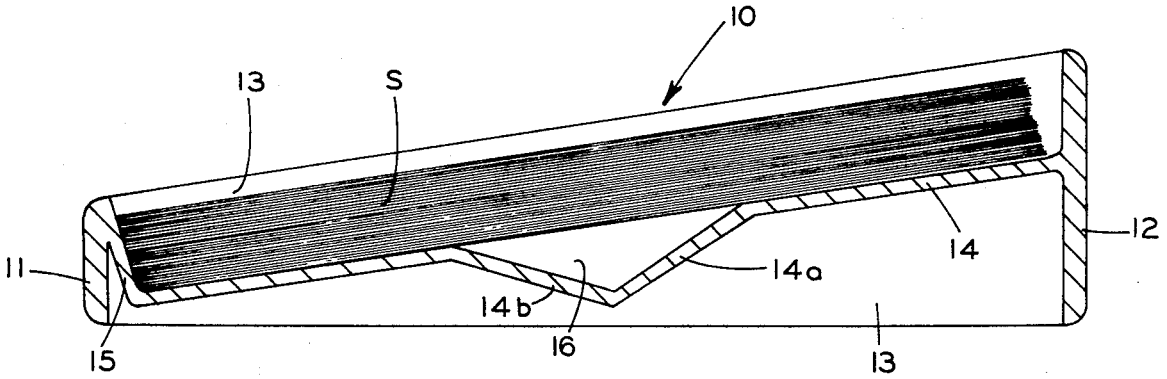
FIG. 2 is a longitudinal sectional elevation of the tray and note paper stack.

The illustrated embodiment comprises a display container or tray 10 of any suitable sheet material, such as plastic or metal, which has a relatively short vertical front wall or part 11 and a relatively long vertical rear wall 12 in parallel relation to the front wall. Integral with the front and rear walls are side panels or walls 13, which are horizontal at the bottom edges and downwardly inclined at the top. A downwardly inclined tray bottom wall 14, generally parallel to the top edge of the side walls 13 and spaced a short distance below it, is integral at its lower end to a downwardly and rearwardly inclined front tray wall 15 which is fixed at its upper end to the upper end of the front wall or part 11.

The tray wall 15 is not parallel to the rear wall 12 but is in inclined relation to it.

Approximately midway of the bottom wall 14 of the tray is a transverse depression or cavity 16 which extends from side to side. As shown, the depression 16 is formed of wall positions **14*a* and 14*b*, which are downwardly inclined in opposite directions and meet in an open V-formation. The bottom of the depression 16 is close to the base level of the tray. The depth of the depression 16 is of the order of the thickness of the stack S of note paper sheets. The depression 16** may be of other forms such as a concavity or even a transverse slot but the form shown is of significance because it is more desirable to exert pressure against a flat instead of a curved or sharp surface.

The stack S of note paper sheets preferably has a certain degree of body stiffness attributable to bond paper. The lower edges of the stacked paper rests against the inclined tray wall 15 and the upper edges are spaced from and free of the rear wall 12.

Figure 3:
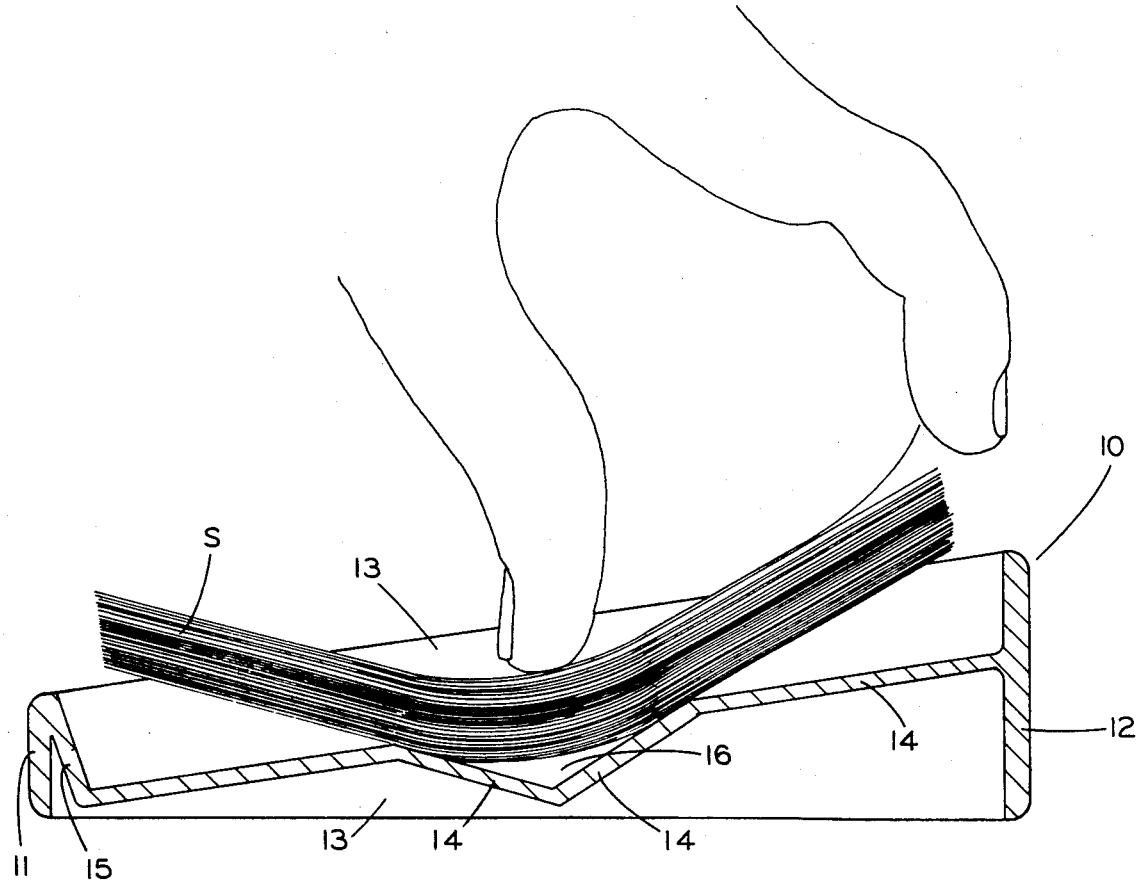
FIG. 3 is a view similar to FIG. 2 and showing ja manner of removing individual paper sheets.

When the center of the paper stack S is pressed downwardly by a finger or thumb, crowding the intermediate portion of the lower part of the stack into the depression, the free edge portions at each end of the stack flex or bend upwardly as shown in FIG. 3, and the free edges of the uppermost sheets free or separate themselves from adjacent sheets. This enables the top sheet to be easily peeled from the stack by a finger or thumb instantaneously. The release of pressure on the stack causes it to flex back to its normal flat position. Thus, removal of individual sheets can be readily achieved without difficulty and obviating problems ordinarily encountered in this endeavor.

The downward inclination of the tray causes the stack S to gravitate to the wall 15 and the outward slanting of the wall 15 facilitating the upward flexing of the stack without interference or scraping contact with the surface of the wall.

Although the preferred embodiment of the invention has been shown and described it is to be understood the changes in details of construction, arrangement and choice of materials may be made without departing from the invention.

What is claimed is:

1. A tray comprising a downwardly inclined bottom wall including a transverse depression separating said bottom wall into two coplanar portions, an upwardly and outwardly inclined end wall affixed to the lower end of said inclined flat bottom wall, a stack of note paper sheets on said bottom wall and abutting said inclined end wall, said transverse depression in said bottom wall disposed approximately midway of said stack whereby manual pressure on the top of said stack forces same into said depression and causes the stack end portions to flex upwardly and free upper sheets of the stack from each other.

2. The invention defined in claim 1 wherein said transverse depression in said bottom wall has a depth substantially equal to the thickness of the stack of note paper sheets.

* * * * *